US010991289B2

(12) United States Patent
Shang et al.

(10) Patent No.: US 10,991,289 B2
(45) Date of Patent: Apr. 27, 2021

(54) MEMORY-IN-PIXEL CIRCUIT, DRIVING METHOD THEREOF, ARRAY SUBSTRATE, AND DISPLAY APPARATUS

(71) Applicant: BOE Technology Group Co., Ltd., Beijing (CN)

(72) Inventors: Guangliang Shang, Beijing (CN); Chengyou Han, Beijing (CN); Mingfu Han, Beijing (CN); Lijun Yuan, Beijing (CN); Xing Yao, Beijing (CN); Haoliang Zheng, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 12 days.

(21) Appl. No.: 16/346,962

(22) PCT Filed: Sep. 27, 2018

(86) PCT No.: PCT/CN2018/107961
§ 371 (c)(1),
(2) Date: May 2, 2019

(87) PCT Pub. No.: WO2019/205485
PCT Pub. Date: Oct. 31, 2019

(65) Prior Publication Data

US 2020/0265763 A1 Aug. 20, 2020

(30) Foreign Application Priority Data

Apr. 26, 2018 (CN) ..... 201810387124.8

(51) Int. Cl.
*G09G 3/20* (2006.01)

(52) U.S. Cl.
CPC ..... *G09G 3/20* (2013.01); *G09G 2300/0426* (2013.01); *G09G 2300/0439* (2013.01); *G09G 2310/0272* (2013.01)

(58) Field of Classification Search
CPC ..... G09G 3/20; G09G 2300/0426; G09G 2300/0439; G09G 2310/0272
See application file for complete search history.

(56) References Cited

U.S. PATENT DOCUMENTS

2002/0185692 A1* 12/2002 Kurokawa ..... H01L 29/42324 257/390
2009/0322731 A1 12/2009 Yasuda
(Continued)

FOREIGN PATENT DOCUMENTS

CN 106935212 A 7/2017
CN 107025889 A 8/2017
(Continued)

OTHER PUBLICATIONS

International Search Report dated Jan. 8, 2019, issued in counterpart application No. PCT/CN2018/107961. (10 pages).

*Primary Examiner* — Kenneth B Lee, Jr.
(74) *Attorney, Agent, or Firm* — Westerman, Hattori, Daniels & Adrian, LLP

(57) ABSTRACT

The present disclosure is related to a memory-in-pixel circuit. The memory-in-pixel circuit comprises a switch sub-circuit, and a data input sub-circuit. The data input sub-circuit comprises a first floating gate transistor and a second floating gate transistor. The data input sub-circuit is configured to transmit a data signal from one of a plurality of data lines to a pixel electrode under control of the switch sub-circuit.

18 Claims, 7 Drawing Sheets

(56) References Cited

U.S. PATENT DOCUMENTS

| | | | |
|---|---|---|---|
| 2012/0038597 | A1 | 2/2012 | Coulson et al. |
| 2017/0124973 | A1 | 5/2017 | Nakao et al. |
| 2017/0221435 | A1 | 8/2017 | Shima |
| 2018/0031893 | A1 | 2/2018 | Tamaki |

FOREIGN PATENT DOCUMENTS

| | | | | |
|---|---|---|---|---|
| JP | 2007-003607 | A | | 1/2007 |
| JP | 2007003607 | A | * | 1/2007 |
| KR | 2014-0099198 | A | | 8/2014 |
| KR | 20140099198 | A | * | 8/2014 |

* cited by examiner

MEMORY-IN-PIXEL CIRCUIT, DRIVING METHOD THEREOF, ARRAY SUBSTRATE, AND DISPLAY APPARATUS

CROSS-REFERENCE TO RELATED APPLICATIONS

This application claims benefit of the filing date of Chinese Patent Application No. 201810387124.8 filed on Apr. 26, 2018, the disclosure of which is hereby incorporated in its entirety by reference.

TECHNICAL FIELD

This disclosure relates to circuit, in particular, to a memory-in-pixel circuit, a driving method thereof, an array substrate, and a display apparatus.

BACKGROUND

Recently, the development of smart wearable devices present high requirement for display panels. Using memory-in-pixel technology in the display panel acts as a new trend for more energy-efficient display technology.

However, nowadays the memory-in-pixel technology is based on the CMOS process, and the pixel circuit which uses the memory-in-pixel technology has a complex process and low qualification rate, thereby increasing the cost of the memory-in-pixel technology and limiting the development and application scope of the memory-in-pixel technology.

BRIEF SUMMARY

Accordingly, one example of the present disclosure is a memory-in-pixel circuit. The memory-in-pixel circuit includes a switch sub-circuit and a data input sub-circuit. The data input sub-circuit may include a first floating gate transistor and a second floating gate transistor. The data input sub-circuit may be configured to transmit a data signal from one of a plurality of data lines and to a pixel electrode under the control of the switch sub-circuit.

Another example of the present disclosure is an array substrate. The array substrate includes a plurality of pixel units. At least one of the pixel units includes the memory-in-pixel circuit according to one embodiment of the present disclosure.

Another example of the present disclosure is a display apparatus comprises an array substrate according to one embodiment of the present disclosure.

Yet, another example of the present disclosure is a driving method of a memory-in-pixel circuit according to one embodiment of the present disclosure. The memory-in-pixel circuit includes a switch sub-circuit and a data input sub-circuit. The data input sub-circuit includes a first floating gate MOSFET and a second floating gate MOSFET. The driving method includes a transmitting step for transmitting control signals from a plurality of control-signal terminals to the data input sub-circuit through the switch sub-circuit under control of a gate signal of a gate line; and transmitting a data signal from one of a plurality of data lines to a pixel electrode through the data input sub-circuit. Only one of the control signals from the plurality of control-signal terminals is a negative voltage.

BRIEF DESCRIPTION OF THE DRAWINGS

The subject matter which is regarded as the invention is particularly pointed out and distinctly claimed in the claims at the conclusion of the specification. The foregoing and other objects, features, and advantages of the invention are apparent from the following detailed description taken in conjunction with the accompanying drawings in which:

DETAILED DESCRIPTION

Figure 1:
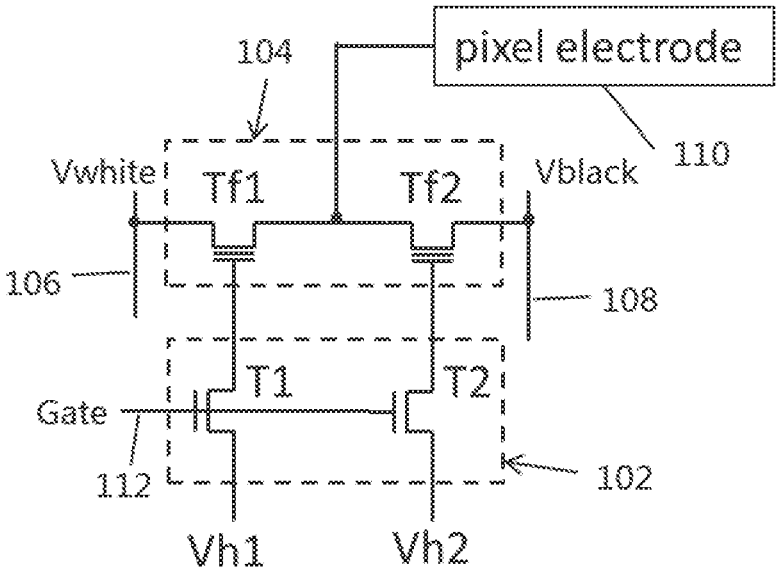
FIG. 1 is a schematic structural diagram of a memory-in-pixel circuit according to some embodiments of the present disclosure.

The present disclosure will be described in further detail with reference to the accompanying drawings and embodiments in order to provide a better understanding by those skilled in the art of the technical solutions of the present disclosure. Throughout the description of the disclosure, reference is made to FIGS. 1-7. When referring to the figures, like structures and elements shown throughout are indicated with like reference numerals.

In this specification, the terms "first," "second," etc. may be added as prefixes. These prefixes, however, are only added in order to distinguish the terms and do not have specific meaning such as order and relative merits. In the description of the present disclosure, the meaning of"plural" is two or more unless otherwise specifically and specifically defined.

In the description of the specification, references made to the term "some embodiments," "one embodiment", "exemplary embodiments," "example", "specific example," or "some examples" and the like are intended to refer that specific features, structures, materials or characteristics described in connection with the embodiment or example are included in at least some embodiments or example of the present disclosure. The schematic expression of the terms does not necessarily refer to the same embodiment or example. Moreover, the specific features, structures, materials or characteristics described may be included in any suitable manner in any one or more embodiments or examples.

Since a source electrode and a drain electrode of a transistor are symmetrical, so the source electrode and the drain electrode thereof are interchangeable. In the current disclosure, a source electrode is called a first electrode; a drain electrode is called a second electrode. According to the figures of this disclosure, a middle terminal of the transistor is a gate electrode, a signal input terminal of the transistor is a source electrode, and a signal output terminal of the transistor is a drain electrode. In addition, the transistors used in the current disclosure can be one of N-type switch transistors and P-type switch transistors. The P-type switch transistor is turned on when the gate electrode is at a low level and turned off when the gate electrode is at a high level. The N-type switch transistor is turned on when the gate electrode is at a high level and turned off when the gate electrode is at a low level. In addition, a plurality of signals in various embodiments of the present disclosure has corresponding effective potentials and non-effective potentials respectively. The effective potential and the non-effective potential only represent two states of the potential of the signals, and do not mean that the effective potential or the non-effective potential in the whole disclosure has a specific value. It can be understood that the effective potential is a signal potential capable of enabling electronic components.

FIG. 1 is a schematic structural diagram of a memory-in-pixel circuit according to some embodiments of the present disclosure. As shown in FIG. 1, the memory-in-pixel circuit includes a switch sub-circuit 102 and a data input sub-circuit 104. The data input sub-circuit 104 may include a first floating gate transistor Tf1 and a second floating gate transistor Tf2. The data input sub-circuit 104 may be configured to transmit a data signal from one of a plurality of data lines 106 and 108 to a pixel electrode 110 under the control of the switch sub-circuit 102.

A floating gate transistor is a transistor containing a floating gate. The floating gate is electrically isolated from its surroundings in the transistor, and the floating gate is configured to retain its charges therein, thereby enabling persistent storage of data bits. In one embodiment, the floating gate transistor is a complementary metal-oxide semiconductor (CMOS) device capable of holding an electrical charge in a memory device that is used to store data. The floating gate transistor has two gates: one is a floating gate, and the other one is a control gate which receives electrical signal. The two gates are separated from each other by a thin dielectric material generally referred to as an oxide layer. Because the floating gate is electrically isolated by the oxide layer and is not electrically connected to anything, any electrons or charges placed on it are trapped there. The oxide layer that surrounds the floating gate keeps the electrons trapped, whether or not the power is applied to the gate electrode, thereby enabling persistent storage of data bits.

If the floating gate is not applied with an electrical potential (i.e. neutral), then the device operates almost like a normal metallic oxide semiconductor field effect transistor (MOSFET).

Figure 2:
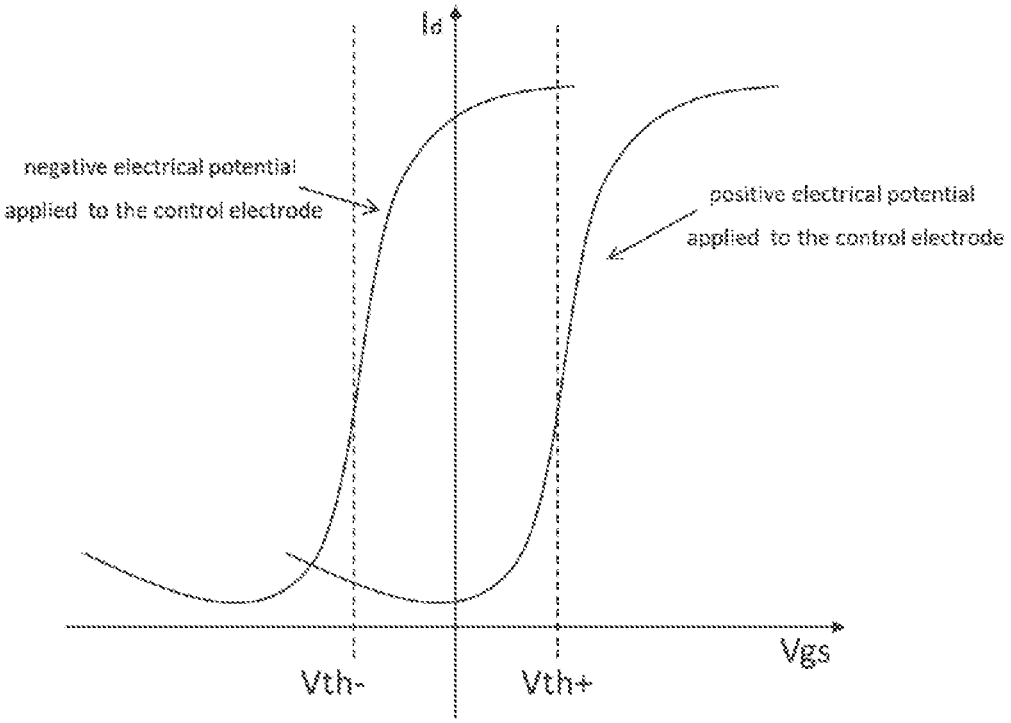
FIG. 2 is a schematic diagram of an output characteristic curve of a floating gate transistor m response to a positive electrical potential or a negative electrical potential applied to the control electrode of the floating gate transistor.

FIG. 2 is a schematic diagram of an output characteristic curve (Vgs-Id) of a floating gate transistor in response to a positive electrical potential or a negative electrical potential applied to the control electrode of the floating gate transistor.

A threshold voltage of a transistor is a minimum voltage applied to the control gate at which a transistor becomes conductive. The control gate adjusts the threshold voltage of the floating gate transistor by controlling the amount of the electrons transitioned to the floating gate through a negative electrical potential or a positive electrical potential.

As shown in FIG. 2, when a negative electrical potential is applied to the control gate of a floating gate transistor, electrons are forced through the oxide layer into the channel, where the electrons are drawn to the positive charge at the source electrode. As a result, the threshold voltage of the floating gate transistor is shifted in a negative direction to Vth−. After removing the negative electrical potential from the control gate, since a positive charge has been formed on the floating gate, a channel is created more easily to carry a current from source to drain. When a positive electrical potential is applied to the control gate of a floating gate transistor, the electrons are attracted from the channel into the floating gate, where they become trapped. As a result, the threshold voltage of the floating gate transistor is shifted in a positive direction to Vth+. After removing the positive electrical potential from the control gate, since the floating gate has been negatively charged, the floating gate can shield the channel region and the control gate to a certain degree and prevent the formation of a channel between the source and the drain.

However, unlike the MOSFET without a floating gate, once the power is lost, the floating gate retains its charge since it isn't electrically connected to anything. Thus, the transistor remembers its "on" state even when the power is lost.

According to its property, the floating gate transistor is much more power saving and compatible with the traditional MOSFET process.

In some embodiments, as shown in FIG. 1, the switch sub-circuit 102 includes a first switch transistor T1 and a second switch transistor T2. A control electrode of the first switch transistor T1 is coupled to a gate line 112, a first electrode of the first switch transistor T1 is coupled to a first control-signal terminal Vh1, and a second electrode of the first switch transistor T1 is coupled to a control electrode of the first floating gate transistor Tf1. A control electrode of the second switch transistor T2 is coupled to the gate line 112, a first electrode of the second switch transistor T2 is coupled to a second control-signal terminal Vh2, and a second electrode of the second switch transistor T2 is coupled to a control electrode of the second floating gate transistor Tf2.

The switch sub-circuit may be configured to transmit a first control-signal from the first control-signal terminal Vh1 and a second control-signal from the second control-signal terminal Vh2 to the first floating gate transistor Tf1 and the second floating gate transistor Tf2 respectively under control of a gate signal of the gate line 112.

In some embodiments, as shown in FIG. 1, the plurality of data lines includes a first data line 106 and a second data line 108. A first electrode of the first floating gate transistor Tf1 is coupled to the first data line 106. A second electrode of the first floating gate transistor Tf1 is coupled to the pixel electrode 110. A first electrode of the second floating gate transistor Tf2 is coupled to the second data line 108. A second electrode of the second floating gate transistor Tf2 is coupled to the pixel electrode 110.

In the above embodiments, for illustration purpose, each of the transistors is an N-type of transistor, and the effective potential is a higher potential relative to the ineffective potential. That is, the first floating gate transistor Tf1 and the second floating gate transistor Tf2 are N-type transistors, and the first switch transistor T1 and the second switch transistor T2 are N-type transistors. In some other embodiments, the transistors can also adopt P-type transistors. When the transistor adopts a P-type transistor, the effective potential is a lower potential relative to the ineffective potential. Furthermore, the potential change of each of the signal terminals can be opposite to the potential change shown in FIG. 7.

In some embodiments of the present disclosure, the memory-in-pixel circuit includes a switch sub-circuit 102, a first floating gate transistor Tf1, a second floating gate transistor Tf2 and a storage sub-circuit 201. The storage sub-circuit 201 may be configured to sustain potentials of the control electrode of the first floating gate transistor Tf1 and the control electrode of the second floating gate transistor Tf2. Specifically, the storage sub-circuit 201 may be configured to sustain a potential of the control electrode of the first floating gate transistor Tf1 at a potential of the first control-signal and a potential of the control electrode of the second floating gate transistor Tf2 at a potential of the second control-signal when the switch sub-circuit 102 is turned on.

Figure 3:
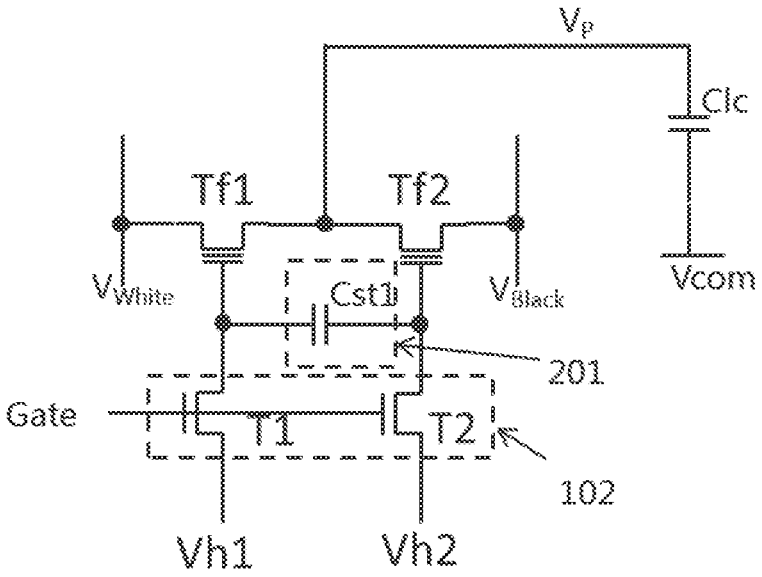
FIG. 3 is a schematic structural diagram of a memory-in-pixel circuit according to some embodiments of the present disclosure.

FIG. 3 is a schematic structural diagram of a memory-in-pixel circuit according to some embodiments contemplated by the present disclosure. As shown in FIG. 3, the storage sub-circuit includes a capacitor Cst1. A first electrode of the capacitor Cst1 is coupled to the control electrode of the first floating gate transistor Tf1, and a second electrode of the capacitor Cst1 is coupled to the control electrode of the second floating gate transistor Tf2.

Figure 4:
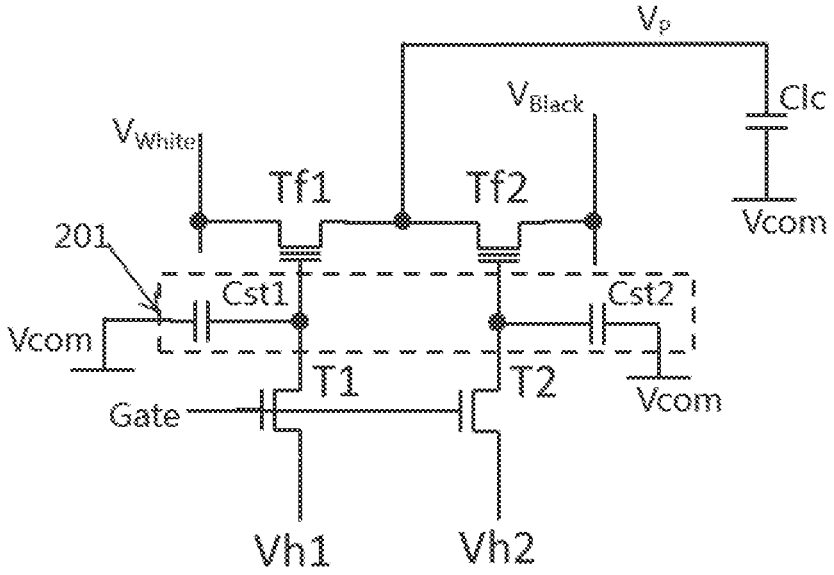
FIG. 4 is a schematic structural diagram of a memory-in-pixel circuit according to some embodiments of the present disclosure.

FIG. 4 is a schematic structural diagram of a memory-in-pixel circuit according to some embodiments contemplated by the present disclosure. As shown in FIG. 4, the storage sub-circuit includes a first capacitor Cst1 and a second capacitor Cst2. A first electrode of the first capacitor Cst1 is coupled to the control electrode of the first floating gate transistor Tf1. A second electrode of the first capacitor Cst1 is coupled to a common electrode Vcom. A first electrode of the second capacitor Cst2 is coupled to the control electrode of the second floating gate transistor Tf2. A second electrode of the second capacitor Cst2 is coupled to a common electrode Vcom. As such, stability of the potentials of the control electrode of the first floating gate transistor Tf1 and the control electrode of the second floating gate transistor Tf2 is further guaranteed.

Figure 5:
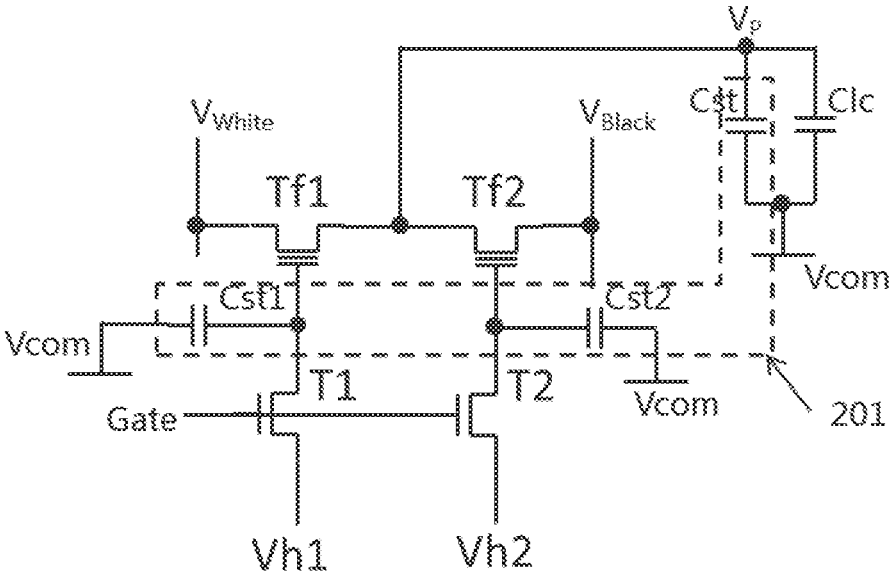
FIG. 5 is a schematic structural diagram of a memory-in-pixel circuit according to some embodiments of the present disclosure.

FIG. 5 is a schematic structural diagram of a memory-in-pixel circuit according to some embodiments contemplated by the present disclosure. As shown in FIG. 5, the storage sub-circuit further includes a third capacitor Cst. A first electrode of the third capacitor Cst is coupled to the pixel electrode Vp. A second electrode of the third capacitor Cst is coupled to a common electrode Vcom. The third capacitor Cst may be configured to sustain a potential of the pixel electrode stably to avoid leaking current of transistors. In some embodiments, the dielectric of the third capacitor Cst is a solid insulating material rather than liquid crystals, thereby guaranteeing stability of the potentials of the pixel electrode.

In some embodiments of the present disclosure, the common electrode can either be a separate layer or be arranged at the same layer with other electrode layers.

Figure 6:
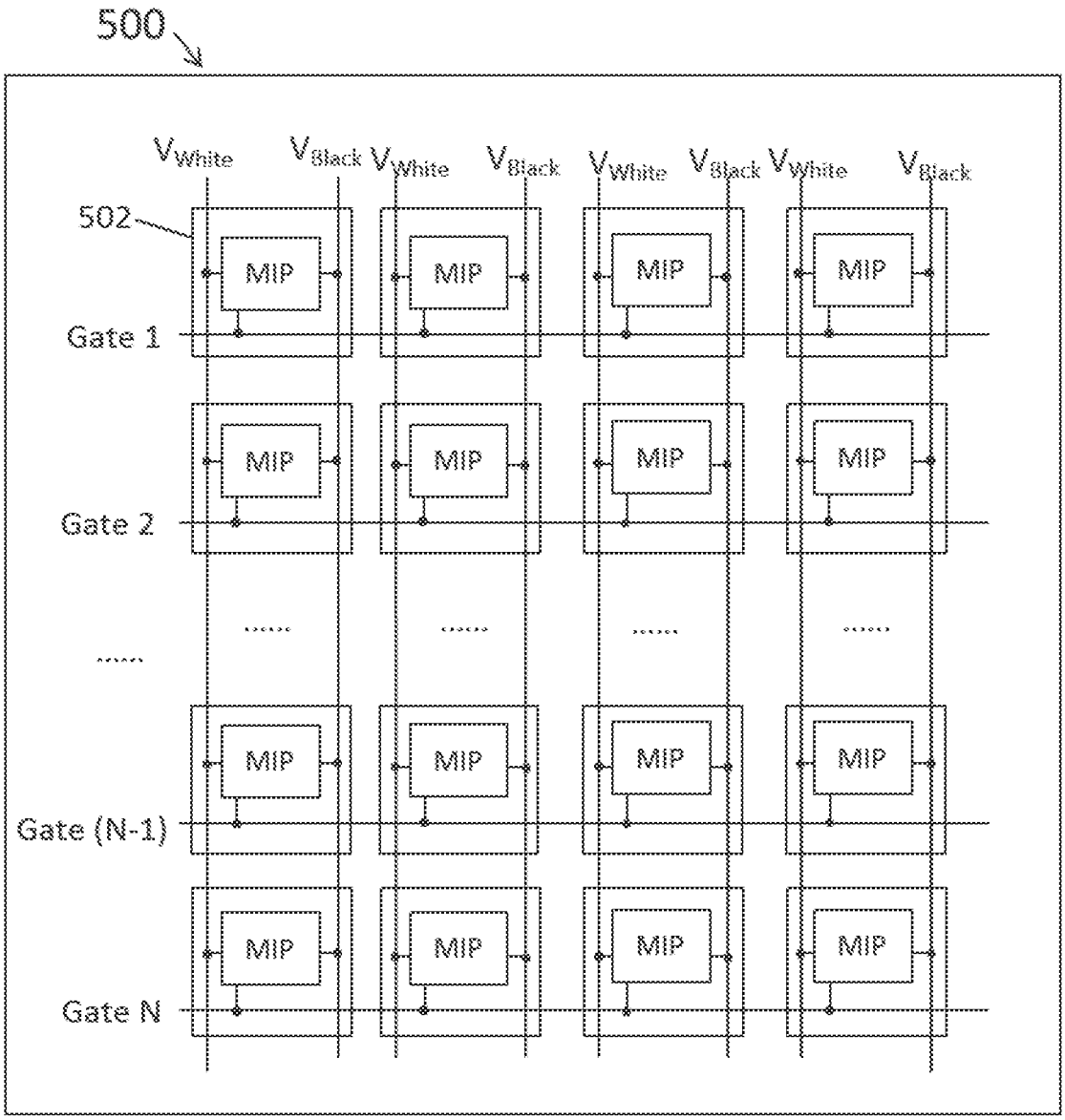
FIG. 6 is a schematic structural diagram of an array substrate according to some embodiments of the present disclosure.

FIG. 6 is a schematic structural diagram of an array substrate according to some embodiments of the present disclosure. As shown in FIG. 6, the array substrate 500 includes a plurality of pixel units 502. At least one of the pixel units 502 includes the memory-in-pixel circuit MIP according to one embodiment of the present disclosure.

In some embodiments, the array substrate may further include a plurality of gate lines, Gate1, Gate2 . . . $Gate_{(N-1)}$, $Gate_N$. The plurality of pixel units 502 are arranged in an array. Switch sub-circuits of the pixel units arranged in a same row are coupled to a same gate line.

In some embodiments of the present disclosure, the common electrode can either be a separate layer or be arranged at the same layer with other electrode layers. For example, the common electrode of the pixel units arranged in the $N^{th}$ row is coupled to the gate electrodes of the pixel units arranged in the $(N-1)^{th}$ row.

A display apparatus is provided according to some embodiments of the present disclosure. The display apparatus includes an array substrate according to any one of embodiments mentioned above. The display apparatus can be a liquid crystal panel, electronic paper, an OLED panel, an AMOLED panel, a mobile phone, a tablet computer, a television, a notebook computer, a digital photo frame, a navigator, or other products or parts with display functions.

The memory-in-pixel circuit described in the embodiments contemplated by the present disclosure is simple and compatible with traditional thin film transistor processes. In the meantime, using the memory-in-pixel circuit in display panel can realize a higher pixel per inch (PPI), especially for low bit and low refresh frequency display panel, such as wearable device (smart watch etc.) and electronic price tag.

Figure 7:
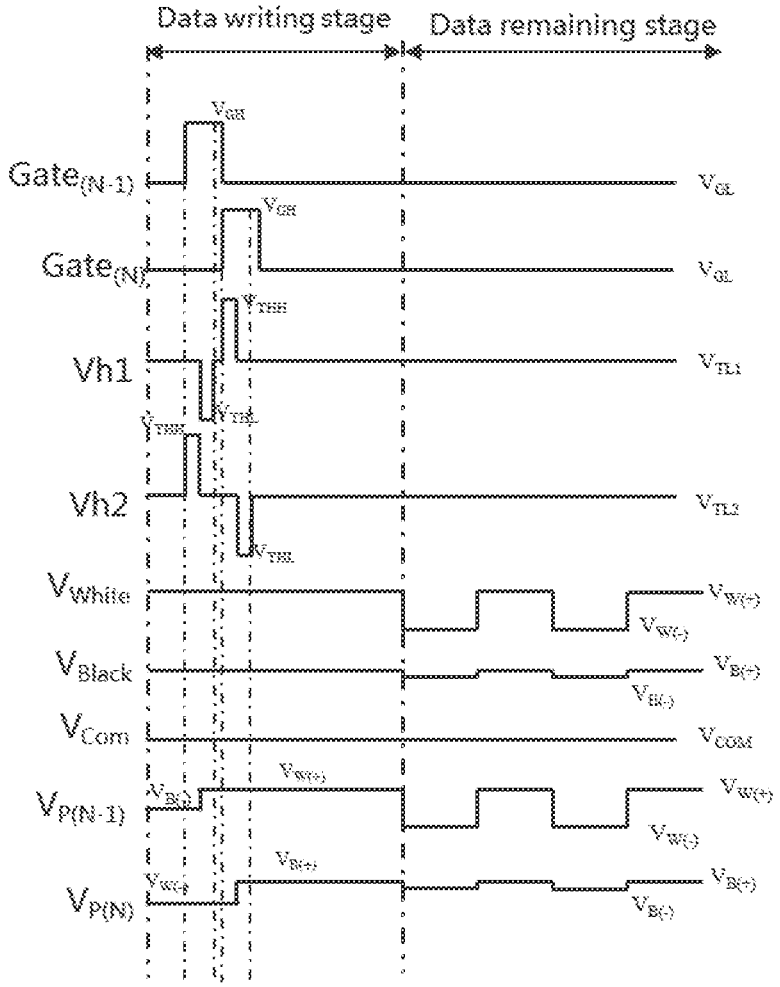
FIG. 7 is a timing diagram of signal terminals in a memory-in-pixel circuit according to some embodiments of the present disclosure.

Another example of the present disclosure is a driving method of a memory-in-pixel circuit. FIG. 7 is a timing diagram of signal terminals in a memory-in-pixel circuit according to some embodiments of the present disclosure. The driving method of the memory-in-pixel circuit provided by the embodiments of the present disclosure includes a data writing stage and a data remaining stage.

In the embodiments, each of the transistors is an N-type of transistor, and the effective potential is a higher potential relative to the ineffective potential. In some other embodiments, the transistors can also adopt P-type of transistors. When the transistor adopts a P-type of transistor, the effective potential is a lower potential relative to the ineffective potential. Furthermore, the potential change of each of the signal terminals can be opposite to the potential change shown in FIG. 7.

During the data writing stage, control signals from a plurality of control-signal terminals (for example, Vh1 and Vh2) are transmitted to the data input sub-circuit through the switch sub-circuit under control of a gate signal of a gate line (for example, $Gate_{(N-1)}$). Furthermore, a data signal (for example, Vwhite or Vblack) from one of a plurality of data lines is transmitted to a pixel electrode through the data input sub-circuit. Only one of the control signals from the plurality of control-signal terminals is a negative voltage.

In one embodiment, transmitting control signals from the plurality of control-signal terminals to the data input sub-circuit through the switch sub-circuit under control of the gate signal of the gate line includes: transmitting a first control signal and a second control signal in sequence from a first control-signal terminal Vh1 and a second control-signal terminal Vh2 to a control electrode of the first floating gate transistor Tf1 and a control electrode of the second floating gate transistor Tf2 respectively, under the control of the gate signal of the gate line.

If the floating gate of the floating gate transistor is negatively charged, the floating gate transistor results in a more positive threshold voltage. Thus, the floating gate transistor will not become conductive when a low potential applied to the control gate of the floating gate transistor. Inversely, if the floating gate is positively charged, the floating gate transistor results in a more negative threshold voltage and the floating gate transistor will become conductive when a low potential is applied to the control gate of the floating gate transistor. Meanwhile, the floating gate transistor retains its charge since it isn't electrically connected to anything. Thus, the floating gate transistor remembers it's "on" state even when power is lost.

As shown in FIG. 7, during the data writing stage, an effective level $V_{GH}$ is output by gate lines $Gate_{(N-1)}$ and $Gate_{(N)}$ in sequence. During the duration of the effective level of $Gate_{(N-1)}$, the first switch transistor T1 and the second switch transistor T2 which are coupled to the gate line $Gate_{(N-1)}$ are turned on. Accordingly, a first control signal and a second control signal from a first control-signal terminal Vh1 and a second control-signal terminal Vh2 are transmitted to a control electrode of the first floating gate transistor Tf1 and a control electrode of the second floating gate transistor Tf2 respectively.

In some embodiments, as shown in FIG. 11, the first electrode of the second floating gate transistor Tf2 is coupled to the second data line 108, which provides a data signal Vblack. The first electrode of the first floating gate transistor Tf1 is coupled to the first data line 106, which provides a data signal Vwhite.

During the duration of the effective level of $Gate_{(N-1)}$, the second control signal becomes $V_{THH}$ first, causing the second floating gate transistor Tf2 to have a more positive threshold voltage first, and then the second control signal returns back to $V_{TL2}$. In the meantime, the first control signal becomes $V_{THL}$ to cause the first floating gate transistor Tf1 to have a more negative threshold voltage, and then the first control signal returns back to $V_{TL1}$.

Accordingly, during the duration of the effective level of $Gate_{(N-1)}$, the second floating gate transistor Tf2 is turned off and the first floating gate transistor Tf1 is turned on to transmit data signal Vwhite from first data line 106 to the pixel electrode 110.

During the duration of the effective level of $Gate_N$, the first switch transistor T1 and the second switch transistor T2 coupled to the gate line $Gate_N$ are turned on. Thus, a first control signal and a second control signal from a first control-signal terminal Vh1 and a second control-signal terminal Vh2 are transmitted to a control electrode of the first floating gate transistor Tf1 and a control electrode of the second floating gate transistor Tf2 respectively.

During the duration of the effective level of $Gate_N$, the first control signal becomes $V_{THH}$ first, causing the first floating gate transistor Tf1 to have a more positive threshold voltage first, and then the first control signal returns back to $V_{TL1}$. In the meantime, the second control signal becomes $V_{THL}$, causing the second floating gate transistor Tf2 to have a more negative threshold voltage, and then the second control signal returns back to $V_{TL2}$.

Accordingly, during the duration of the effective level of $Gate_N$, the first floating gate transistor Tf1 is turned off and the second floating gate transistor Tf2 is turned on to transmit data signal Vblack from second data line 108 to the pixel electrode 110.

When a pixel electrode is going to receive a data signal $V_{black}$, that means the second floating gate transistor Tf2 should be turned on and the first floating gate transistor Tf1 should be turned off. Inversely, when a pixel electrode is going to receive a data signal $V_{white}$, that means the second floating gate transistor Tf2 should be turned off and the first floating gate transistor Tf1 should be tinned on.

A transistor will be turned on when $Vgs>V_{th}$ and turned off when Vgs<Vth. Vgs is the voltage difference between the voltage of the gate electrode of the transistor and the voltage of the source electrode of the transistor. Vth is the threshold voltage of the transistor.

In some embodiments, since the Vgs of the first floating gate transistor Tf1 and the second floating gate transistor Tf2 are determined by the potential of $V_{TL1}$ and $V_{TL2}$ respectively, to make sure the first floating gate transistor Tf1 and the second floating gate transistor Tf2 remain at a stable status, the potential of $V_{TL1}$ and $V_{TL2}$ are in the ranges shown blow:

| | $V_{TL1}$ | $V_{TL2}$ |
|---|---|---|
| Black | $<(V_{th+} - V_{B-})$ | $>(V_{th-} + V_{B+})$ |
| White | $>(V_{th-} - V_{W+})$ | $<(V_{th+} - V_{W-})$ |

The $V_{th+}$ and $V_{th-}$ are the positive shift and negative shift of the threshold voltage of the floating gate transistor respectively. Amplitude of $V_{B+}$ relative to a reference potential is substantially same as amplitude of $V_B$, relative to a reference potential. The reference potential may be the potential of the common electrode, for example, the reference potential is 0V. A phase of $V_{B+}$ is opposite from a phase of Va. The amplitude of $V_{W+}$ relative to a reference potential is substantially same as amplitude of $V_{W-}$ relative to a reference potential. The $V_{W+}$ is a higher potential than the reference potential, and the $V_{W-}$ is a lower potential than the reference potential. The reference potential may be the potential of the common electrode. For example, the reference potential is 0V, the phase of $V_{W+}$ is opposite from the phase of $V_{W-}$.

As shown in FIG. 7, in some embodiments of the present disclosure, an amplitude of the first control signal $V_{THL}$ is substantially the same as an amplitude of the second control signal $V_{THH}$; a phase of the first control signal $V_{THL}$ is opposite from a phase of the second control signal $V_{THH}$.

In an embodiment of the present disclosure, each of the transistors is an N-type, the range of values of the $V_{THL}$ is between about −30V to about −20V, and the range of values of the $V_{THH}$ is between 20V to 30V. The range of values of the $V_{GH}$ is between 25V to 35V; the range of values of the $V_{GL}$ is between −35V to −25V.

During the data remaining stage, the first control-signal terminal Vh1 and the second control-signal terminal Vh2 both remain at a low potential, and the data signal from the plurality of the data lines becomes square-wave signal to save power consumption.

During the data remaining stage, a common signal of the common electrode can also become a square-wave signal with a frequency same to the data signal, for saving more power consumption.

Compared with a memory-in-pixel circuit in the related art which consists only of transistors without floating gates, the circuit provided by the embodiments of the present disclosure have advantages such as reducing power consumption and cost of manufacture and improved product yield.

As shown in FIG. 7, in some embodiments of the present disclosure, a potential of a data signal from each of the plurality of data lines is different from one another, specifically, the data signal Vwhite has different potential of data signal Vblack, in order to realize different gray scale in a pixel unit.

The principle and the embodiment of the disclosure are set forth m the specification. The description of the embodiments of the present disclosure is only used to help understand the method of the present disclosure and the core idea thereof. Meanwhile, for a person of ordinary skill in the art, the disclosure relates to the scope of the disclosure, and the technical embodiment is not limited to the specific combination of the technical features, and also should covered other technical embodiments which are formed by combining the technical features or the equivalent features of the technical features without departing from the inventive concept. For example, technical embodiments may be obtained by replacing the features described above as disclosed in this disclosure (but not limited to) with similar features.

What is claimed is:

1. A memory-in-pixel circuit, comprising, a switch sub-circuit, and a data input sub-circuit, the data input sub-circuit comprising a first floating gate transistor and a second floating gate transistor, wherein the data input sub-circuit is configured to transmit a data signal from one of a plurality of data lines to a pixel electrode under control of the switch sub-circuit, a threshold voltage of each of the first floating gate transistor and the second floating gate transistor is configured to shift negatively when a negative gate voltage is applied and shift positively when a positive gate voltage is applied, and the first floating gate transistor and the second floating gate transistor have a threshold voltage, a positive threshold voltage shift of the threshold voltage ($V_{th-}$), and a negative voltage shift of the threshold voltage ($V_{th+}$); a first data signal is transmitted through the first floating gate transistor, and a second data signal is transmitted through the second floating gate transistor; $V_{w+}$ is a high voltage of the first data signal in a data remain stage, $V_{w-}$ is a low voltage of the first data signal in the data remain stage; $V_{B+}$ is a high voltage of the second data signal in the data remain stage, $V_{B-}$ is a low voltage of the second data signal in the data remain stage; $V_{TL1}$ is a control voltage of the first floating gate in the data remain stage, and $V_{TL2}$ is a control voltage of the second floating gate in the data remain stage; the first floating gate transistor and the second floating gate transistor maintain a stable status in the data remain stage with $V_{TL1}$ and $V_{TL2}$ in ranges limited by $V_{th+}$, $V_{th-}$, $V_{B+}$, $V_{B-}$, $V_{w+}$, and $V_{W-}$.

2. The memory-in-pixel circuit according to claim 1, wherein the switch sub-circuit comprises a first switch transistor and a second switch transistor;

a control electrode of the first switch transistor is coupled to a gate line, a first electrode of the first switch transistor is coupled to a first control-signal terminal, a second electrode of the first switch transistor is coupled to a control electrode of the first floating gate transistor; and a control electrode of the second switch transistor is coupled to the gate line, a first electrode of the second switch transistor is coupled to a second control-signal terminal, a second electrode of the second switch transistor is coupled to a control electrode of the second floating gate transistor.

3. The memory-in-pixel circuit according to claim 2, wherein the switch sub-circuit is configured to transmit a first control-signal from the first control-signal terminal and a second control-signal from the second control-signal terminal to the first floating gate transistor and the second floating gate transistor respectively under control of a gate signal of the gate line.

4. The memory-in-pixel circuit according to claim 1, wherein, the plurality of data lines comprises a first data line and a second data line;

a first electrode of the first floating gate transistor is coupled to the first data line, a second electrode of the first floating gate transistor is coupled to the pixel electrode; and a first electrode of the second floating gate transistor is coupled to the second data line, a second electrode of the second floating gate transistor is coupled to the pixel electrode.

5. The memory-in-pixel circuit according to claim 1, wherein the first floating gate transistor and the second floating gate transistor are n-type transistors, and the first switch transistor and the second switch transistor are n-type transistors.

6. The memory-in-pixel circuit according to claim 4, further comprising, a storage sub-circuit, wherein the storage sub-circuit is configured to sustain potentials of the control electrode of the first floating gate transistor and the control electrode of the second floating gate transistor.

7. The memory-in-pixel circuit according to claim 4, further comprising, a storage sub-circuit, wherein the storage sub-circuit is configured to sustain a potential of the control electrode of the first floating gate transistor at a potential of the first control-signal and a potential of the control electrode of the second floating gate transistor at a potential of the second control-signal when the switch sub-circuit is turned on.

8. The memory-in-pixel circuit according to claim 6, wherein the storage sub-circuit comprises a capacitor, a first electrode of the capacitor is coupled to the control electrode of the first floating gate transistor, and a second electrode of the capacitor is coupled to the control electrode of the second floating gate transistor.

9. The memory-in-pixel circuit according to claim 6, wherein the storage sub-circuit comprises a first capacitor and a second capacitor;

a first electrode of the first capacitor is coupled to the control electrode of the first floating gate transistor, a second electrode of the first capacitor is coupled to a common electrode:

a first electrode of the second capacitor is coupled to the control electrode of the second floating gate transistor, and a second electrode of the second capacitor is coupled to a common electrode.

10. The memory-in-pixel circuit according to claim 8, further comprising a third capacitor;

wherein a first electrode of the third capacitor is coupled to the pixel electrode, a second electrode of the third capacitor is coupled to a common electrode; and the third capacitor is configured to sustain a potential of the pixel electrode.

11. The memory-in-pixel circuit according to claim 10, wherein a dielectric of the third capacitor is insulating material.

12. An array substrate, comprising a plurality of pixel units, wherein at least one of the plurality of the pixel units comprises the memory-in-pixel circuit according to claim 1.

13. The array substrate according to claim 12, comprising a plurality of gate lines, wherein the plurality of pixel units are arranged in an array, and switch sub-circuits arranged in a same row are coupled to a same gate line.

14. A display apparatus, comprising the array substrate according to claim 12.

15. A driving method of a memory-in-pixel circuit, wherein, the memory-in-pixel circuit comprises a switch sub-circuit and a data input sub-circuit, the data input sub-circuit comprising a first floating gate transistor and a second floating gate transistor; the driving method comprising:

transmitting control signals from a plurality of control-signal terminals to the data input sub-circuit through the switch sub-circuit under control of a gate signal of a gate line; and transmitting a data signal from one of a plurality of data lines to a pixel electrode through the data input sub-circuit, wherein only one of the control signals from the plurality of control-signal terminals is a negative voltage, a threshold voltage of each of the first floating gate transistor and the second floating gate transistor is configured to shift negatively when a negative gate voltage is applied and shift positively when a positive gate voltage is applied, and the first floating gate transistor and the second floating gate transistor have a threshold voltage, a positive threshold voltage shift of the threshold voltage ($V_{th-}$), and a negative voltage shift of the threshold voltage ($V_{th+}$); a first data signal is transmitted through the first floating gate transistor, and a second data signal is transmitted through the second floating gate transistor; $V_{w+}$ is a high voltage of the first data signal in a data remain stage. $V_{w-}$ is a low voltage of the first data signal in the data remain stage: $V_{B+}$ is a high voltage of the second data signal in the data remain stage, $V_{B-}$ is a low voltage of the second data signal in the data remain stage; $V_{TL1}$ is a control voltage of the first floating gate in the data remain stage, and $V_{TL2}$ is a control voltage of the second floating gate in the data remain stage; the first floating gate transistor and the second floating gate transistor maintain a. stable status in the data remain stage with $V_{TL1}$ and $V_{TL2}$ in ranges limited by $V_{th+}$, $V_{th-}$, $V_{B+}$, $V_{B-}$, $V_{w+}$, and $W_{w-}$.

16. The driving method according to claim 15, wherein transmitting control signals from the plurality of control-signal terminals to the data input sub-circuit through the switch sub-circuit under control of the gate signal of the gate line comprises:

transmitting a first control signal and a second control signal in sequence from a first control-signal terminal and a second control-signal terminal to a control electrode of the first floating gate transistor and a control electrode of the second floating gate transistor respectively under the control of the gate signal of the gate line.

17. The driving method according to claim 16, wherein, an amplitude of the first control signal is substantially the same as an amplitude of the second control signal;

a phase of the first control signal is opposite from a phase of the second control signal.

18. The driving method according to claim 15, wherein a potential of a data signal from each of the plurality of data lines is different from one another.

* * * * *